US008048368B2

(12) United States Patent
Nazmy et al.

(10) Patent No.: US 8,048,368 B2
(45) Date of Patent: Nov. 1, 2011

(54) HIGH TEMPERATURE AND OXIDATION RESISTANT MATERIAL

(75) Inventors: Mohamed Youssef Nazmy, Fislisbach (CH); Markus Staubli, Dottikon (CH); Andreas Künzler, Baden (CH)

(73) Assignee: ALSTOM Technology Ltd., Beden (CH)

( * ) Notice: Subject to any disclaimer, the term of this patent is extended or adjusted under 35 U.S.C. 154(b) by 131 days.

(21) Appl. No.: 12/622,784

(22) Filed: Nov. 20, 2009

(65) Prior Publication Data

US 2010/0129256 A1 May 27, 2010

(30) Foreign Application Priority Data

Nov. 26, 2008 (CH) ..... 1844/08

(51) Int. Cl.
*C22C 19/03* (2006.01)

(52) U.S. Cl. ..... 420/456; 420/441

(58) Field of Classification Search ..... 148/426–429; 420/441–460; *C22C 19/00, 19/03, 19/05*
See application file for complete search history.

(56) References Cited

U.S. PATENT DOCUMENTS

| | | | | |
|---|---|---|---|---|
| 4,478,791 | A | 10/1984 | Huang et al. | |
| 4,612,165 | A | 9/1986 | Liu et al. | |
| 5,116,438 | A | 5/1992 | Darolia et al. | |
| 5,943,138 | A | 8/1999 | Fujiki | |
| 6,153,313 | A * | 11/2000 | Rigney et al. | 428/632 |
| 6,998,151 | B2 * | 2/2006 | Grylls et al. | 427/191 |
| 2005/0003227 | A1 * | 1/2005 | Khan et al. | 428/632 |

FOREIGN PATENT DOCUMENTS

DE 3630328 3/1988

OTHER PUBLICATIONS

Search Report for European Patent App. No. 09176306.0 (May 4, 2010).

Darolia, R., "MiAl for Turbine Airfoil Application," Structural Intermetallics 1993, pp. 495-504, The Minerals, Metals & Materials Society.

Palm, M., et al., "Production-scale processing of a new intermetallic NiAl-Ta-Cr alloy for high-temperature application Part I. Production of master alloy remelt ingots and investment casting of combustor liner model panels," J. Materials Processing Technol. 2003;136:105-113; Elsevier Science B.V.

Robouch, B. V., et al., "Strained-tetrahedra statistical model for atomic distances and site occupations in ternary intermetallic M3(XX') structures Ni3(alFe) case," J. Alloys & Compounds 2003;359:73-78; Elsevier B.V.

Song, Y., et al., "First Principles Study of Site Substitution of Ternary Elements in NiAl," Acta mater. 2001;49:1647-1654; Elsevier Science Ltd., Great Britain.

Zeumer, B., et al., "Deformation behaviour of intermetallic NiAl-Ta alloys with strengthening Laves phase for high-temperature applications. II. Effects of alloying with Nb and other elements," Intermetallics 1997;5:641-649; Elsevier Science Ltd., Great Britain.

Search Report for Swiss Patent App. No. 01844/2008 (Mar. 12, 2009).

* cited by examiner

*Primary Examiner* — Scott Kastler
*Assistant Examiner* — Vanessa Velasquez
(74) *Attorney, Agent, or Firm* — Cermak Nakajima LLP; Adam J. Cermak

(57) ABSTRACT

High-temperature materials, based on alloyed intermetallic NiAl, have the following chemical composition (values in % by weight):
26-30 Al,
1-6 Ta,
0.1-3 Fe,
0.1-1.5 Hf,
0.01-0.2 B,
0-1 Ti,
0.1-5 Pd,
with the remainder Ni and production-related impurities. The materials have excellent properties, in particular good strength and extremely high oxidation resistance, at very high temperatures of 1300° C., for example.

14 Claims, 2 Drawing Sheets

HIGH TEMPERATURE AND OXIDATION RESISTANT MATERIAL

This application claims priority under 35 U.S.C. §119 to Swiss application no. 01844/08, filed 26 Nov. 2008, the entirety of which is incorporated by reference herein.

BACKGROUND

1. Field of Endeavor

The invention relates to the field of materials engineering. The invention concerns a high temperature-resistant material based on alloyed intermetallic NiAl which does not melt even at temperatures greater than approximately 1800 K and which has very good oxidation resistance at high operating temperatures.

2. Brief Description of the Related Art

To increase the efficiency of gas turbines, the turbines are run at very high operating temperatures, for example. Therefore, gas turbine components such as turbine blades or heat accumulation segments, for example, on the one hand must be resistant to high temperature, i.e., still have adequate strength at high temperatures, and on the other hand must also have high oxidation resistance.

It is known from the prior art to preferentially use superalloys for such gas turbine components, in particular based on nickel and in particular having a monocrystalline or directionally solidified structure, in which use is typically made of a γ/γ' precipitation hardening mechanism for improving the mechanical high-temperature properties. At high temperatures these superalloys have, among other properties, very good material strength as well as excellent corrosion and oxidation resistance and good creep characteristics.

It is further known to additionally protect such hot gas components from the above-referenced extreme stress conditions by use of specialized coatings. In U.S. Pat. No. 5,043,138, for example, a coating is described which is a typical Ni-based superalloy (monocrystalline alloy) with added yttrium and silicon. Although these elements improve the creep resistance and also result in a low ductile-brittle transition temperature, the additional elements W, Mo contained therein and the low proportions of Cr and Co have an adverse effect on the oxidation resistance.

In addition to nickel aluminides, high-strength intermetallic materials are known which, although they are competitive with the nickel-based superalloys to a certain extent, have the disadvantage of low ductility and a high ductile-brittle transition (DBT) temperature in comparison to the ductile, high-tenacity Ni-based superalloys (R. Dariola: NiAl for Turbine Airfoil Application, Structural Intermetallics, The Minerals, Metals & Materials Society, 1993, pp. 495-504), which is reflected in low ductility of these materials at low temperatures. In addition, the heat resistance is unsatisfactory. In contrast, their low density is advantageous.

β-phase Ni aluminides microalloyed with gallium are known from U.S. Pat. No. 5,116,438. With up to approximately 0.25 atomic percent Ga, these materials have significantly improved ductility at room temperature. However, a higher Ga fraction has an adverse effect.

It is known from U.S. Pat. Nos. 4,478,791 and 4,612,165, for example, to add small fractions of boron as well as Hf, Zr, Fe, and combinations of these elements to $Ni_3Al$ materials (with an Al fraction of approximately 10-13% by weight and the remainder Ni) to improve the ductility. DE 36 30 328 C2 provides for the addition of increased quantities of iron (14-17% by weight) to such $Ni_3Al$ materials to improve the heat-toughness and processability. The Al fractions cited therein are approximately 10% by weight. In addition, up to approximately 4% by weight Mo and/or up to 0.1% by weight C must be added to increase the oxidation resistance.

The materials known heretofore based on intermetallic Ni aluminides are in need of improvement with regard to resistance to high temperature and oxidation on account of the increasingly high stress conditions in thermal turbomachinery, in particular gas turbines. It is desirable to alloy intermetallic compounds in such a way that the ductility of the intermetallic NiAl materials is improved, but at the same time the ordered atomic structure is preserved, thus achieving, for example, a high melting point and high strength values at high temperatures. A further aim is to provide very good oxidation resistance.

SUMMARY

One of numerous aspects of the present invention relates to a high temperature-resistant material based on alloyed intermetallic NiAl which does not melt even at temperatures greater than approximately 1800 K and which has very good oxidation resistance at high operating temperatures.

Another aspect relates to a material which has the following chemical composition (values in % by weight):

26-30 Al,
1-6 Ta,
0.1-3 Fe,
0.1-1.5 Hf,
0.01-0.2 B,
0-1 Ti,
0.1-5 Pd,
with the remainder Ni and production-related impurities.

An exemplary material embodying principles of the present invention contains 1-6%, preferably 4.7%, by weight Ta. Ta acts as a precipitation solidifier and increases the resistance to high temperature. However, use of greater than 6% by weight Ta disadvantageously decreases the oxidation resistance.

The addition of iron in the referenced range of 0.1 to 3%, preferably 0.2 to 1.6%, by weight increases the ductility.

Boron is an element which in the stated quantities of 0.01 to 0.2%, preferably 0.1%, by weight solidifies the grain boundaries. Higher boron concentrations are critical, since they may result in undesired boron deposits which have an embrittling effect. The interaction of boron with the other components, in particular Ta, results in good strength values.

Hf (in the stated range of 0.1 to 1.5%, preferably 0.5 to 1.2%, by weight) and Pd (in the stated range of 0.1 to 5%, preferably 0.5%, by weight) likewise contribute to increased strength. However, exceeding the referenced ranges disadvantageously results in embrittlement of the material.

The addition of 1% by weight Ti advantageously increases the hardness of the material.

High-temperature materials adhering to principles of the present invention based on alloyed intermetallic NiAl have superior properties, in particular good creep strength, at very high temperatures of 1300° C., and also have extremely high oxidation resistance.

BRIEF DESCRIPTION OF THE DRAWINGS

Exemplary embodiments of the invention are illustrated in the drawings, which show the following.

DETAILED DESCRIPTION OF EXEMPLARY EMBODIMENTS

The invention is explained in greater detail below with reference to exemplary embodiments and the drawings.

The commercial Ni-based superalloys Hastelloy X, Haynes 214, and CMSX4 known from the prior art as well as various alloyed intermetallic NiAl high-temperature materials according to principles of the invention, having descriptors VHTIM-1 to VHTIM-6, were investigated with regard to their properties at high temperatures. Table 1 below lists the chemical compositions of the particular test materials.

The comparative alloys Hastelloy X, Haynes 214, and CMSX4 were investigated in the fully heat-treated state (according to the manufacturer's instructions).

The alloys VHTIM-1 to VHTIM-6 were produced as follows:

A button weighing approximately 50 g for the six investigated materials was melted in a smelting furnace (electric arc). This button was then subjected to heat treatment for 12 hours at 1100° C. and was subsequently cooled to room temperature in the furnace.

Figure 1:
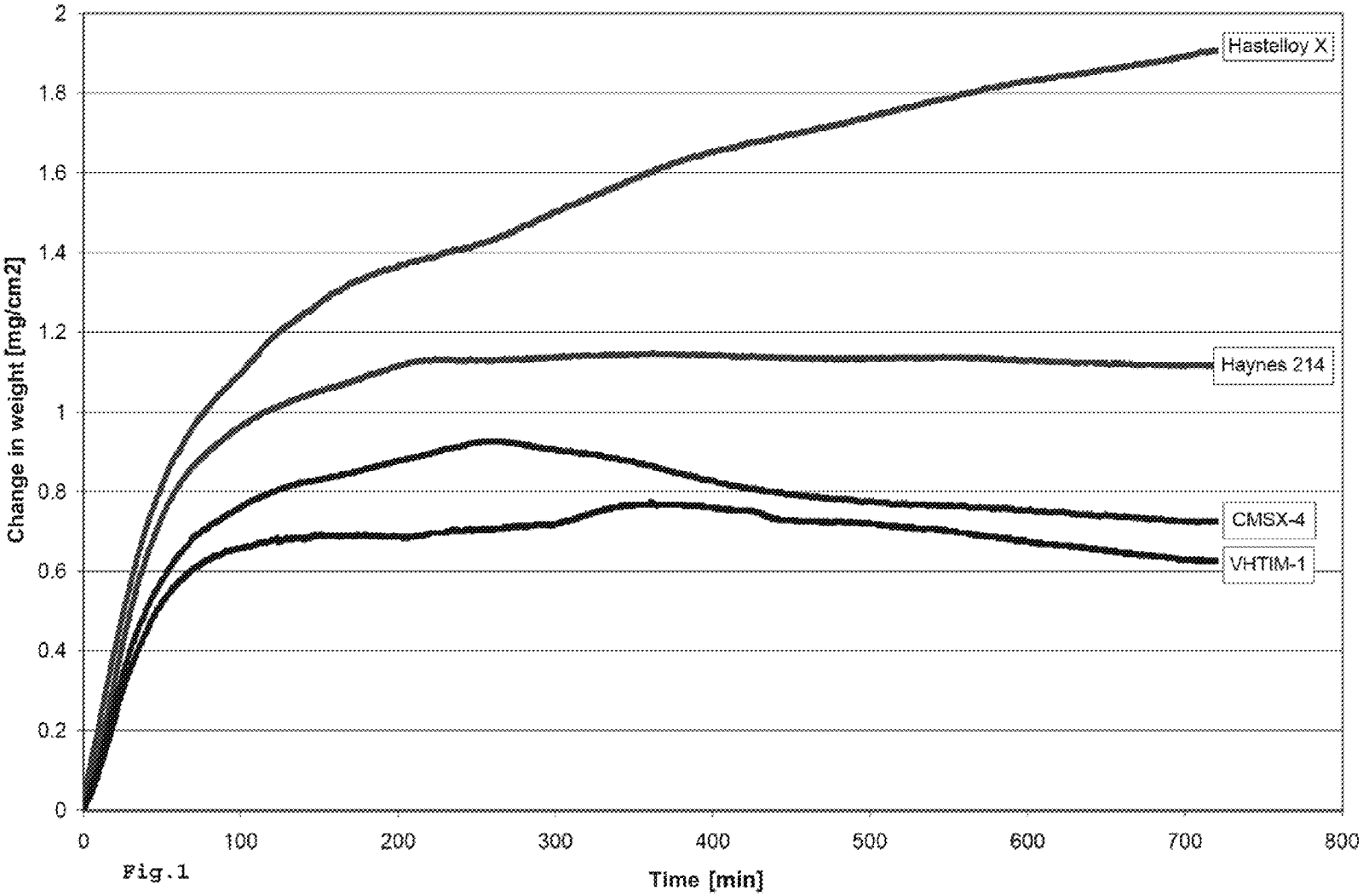
FIG. 1 shows the change in weight as a function of the storage time at 1200° C. for various materials.

The change in weight as a function of the storage period of up of 12 hours maximum at 1200° C. is plotted in FIG. 1 for four investigated materials. It is clearly seen that over the entire investigation period the change in weight of the VTIM-3 material was significantly less than that of the nickel-based superalloys Hastelloy X, Haynes 214, and CMSX-4 known from the prior art and investigated here. Thus, this high-temperature material according to the invention advantageously has a much higher oxidation resistance at 1200° C.

Figure 2:
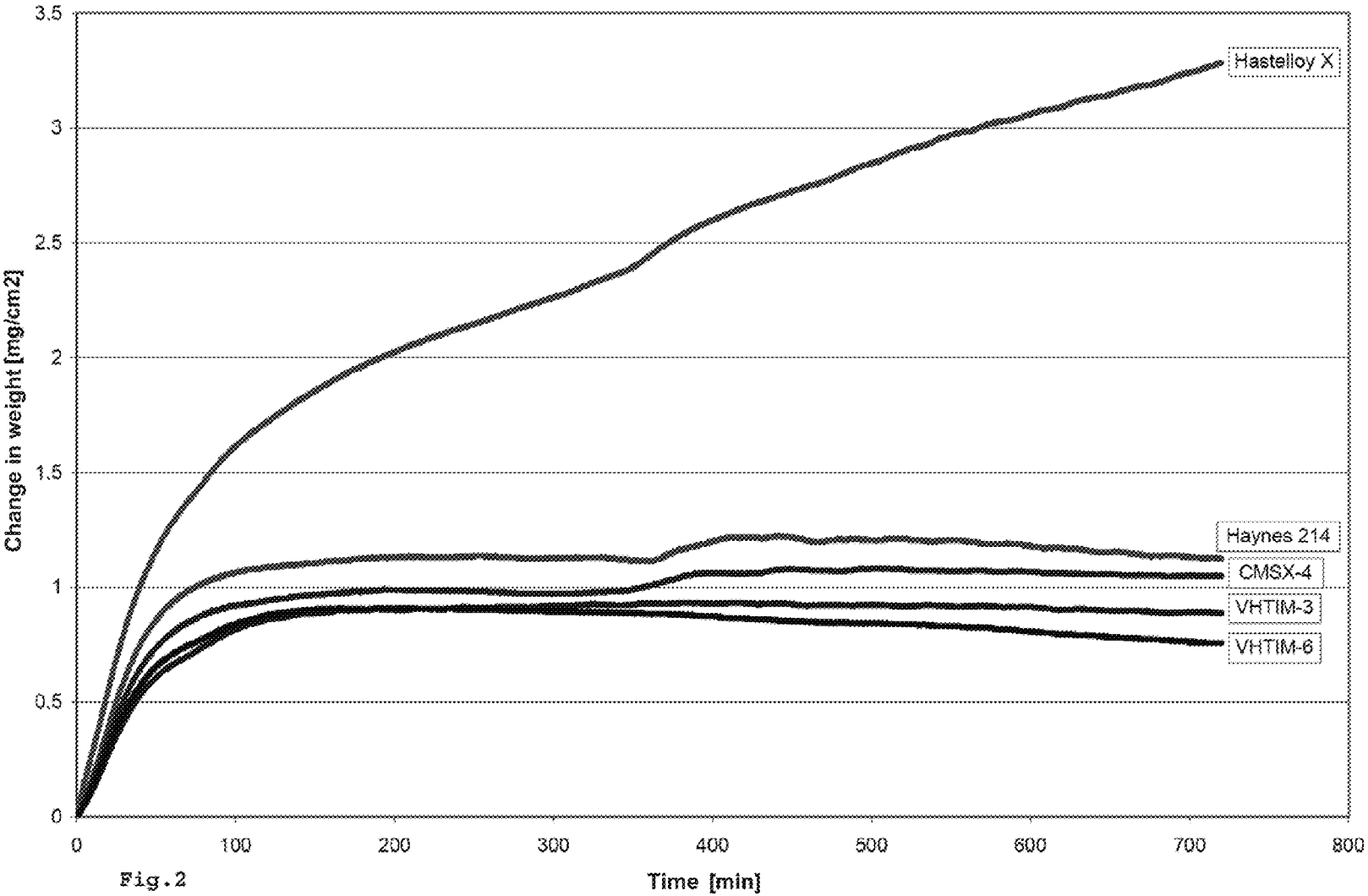
FIG. 2 shows the change in weight as a function of the storage time at 1300° C. for various materials.

Such a conclusion may also be drawn from FIG. 2. In this case the change in weight as a function of the storage period of up of 12 hours maximum at 1300° C. is shown for various materials. The commercial nickel-based superalloy Hastelloy X had the greatest change in weight and therefore the poorest oxidation resistance. After a storage period of approximately 12 hours at 1300° C., the change in weight for this comparative alloy was approximately four times that of the two materials VHTIM-3 and VHTIM-6. However, over the entire storage period the two other comparative alloys Haynes 214 and CMSX-4 disadvantageously showed a greater change in weight than VHTIM-3 and VHTIM-6.

The results of DTA (Differential Thermal Analysis) investigations show that materials according to the invention is very stable. No phase transformations occur in the temperature range from room temperature to above 1500° C. The melting points determined for the alloys known from the prior art and investigated here were 1350° C. for Hastelloy X, 1367° C. for Haynes 214, and 1352° C. for CMSX-4, whereas the melting points for the high-temperature materials were in the temperature range of 1550° C. to >1600° C.

These excellent properties are achieved as the result of the stated combinations of the various elements added to intermetallic nickel aluminide. Modified alloyed intermetallic Ni aluminides are obtained in this manner.

The influences of the additional elements are as follows:

The addition of 1 to 6%, preferably 2-5%, more preferably 4.7%, by weight Ta increases the resistance to high temperature. However, use of greater than 6% by weight Ta disadvantageously decreases the oxidation resistance.

The addition of iron in the referenced range of 0.1 to 3%, preferably 0.2 to 2.0%, more preferably 0.2 to 1.6%, by weight increases the ductility.

Boron is an element which in the stated quantities of 0.01 to 0.2%, preferably 0.01 to 0.1%, more preferably 0.1%, by weight solidifies the grain boundaries. Higher boron concentrations are critical, since they may result in undesired boron deposits which have an embrittling effect. The interaction of boron with the other components, in particular Ta, results in good strength values. On the other hand, increased ductility is achieved by microalloying with B.

Hf (in the stated range of 0.1 to 1.5%, preferably 0.5 to 1.2%, by weight) and Pd (in the stated range of 0.1 to 5%, preferably 1-3%, more preferably 0.5%, by weight) likewise contribute to increased strength. However, exceeding the referenced ranges disadvantageously results in embrittlement of the material.

The addition of 1% by weight Ti advantageously increases the hardness of the material. The aluminum content can be between 27-28% by weight.

High temperature- and oxidation-resistant alloyed intermetallic Ni aluminides adhering to principles of the present invention may advantageously be used for high-temperature components in gas turbines. Named as examples of such are platings on heat protection shields, or caps on the tips of high-pressure blades.

Of course, the invention is not limited to the exemplary embodiments described.

TABLE 1

Chemical composition of the investigated materials (R = Remainder)

| | Ni | Cr | Co | Mo | W | Fe | Mn | Si | C | Al | Ta | Y | B | Re | Hf | Pd | Ti |
|---|---|---|---|---|---|---|---|---|---|---|---|---|---|---|---|---|---|
| Hastelloy X | R | 22 | 1.5 | 9 | 0.6 | 18.5 | 0.5 | 0.5 | 0.1 | 0.3 | — | — | — | — | — | — | — |
| Haynes 214 | R | 16 | — | — | — | 3 | — | — | — | — | — | 0.01 | — | — | — | — | — |
| CMSX4 | R | 6.5 | 9 | 0.6 | 6 | — | — | — | — | 5.6 | 6.5 | — | — | 3 | 0.1 | — | 1 |
| VHTIM-1 | R | — | — | — | — | 1.6 | — | — | — | 27.5 | 4.7 | — | 0.1 | — | 1.2 | — | — |
| VHTIM-2 | R | — | — | — | — | 1.6 | — | — | — | 27.5 | 4.7 | — | 0.1 | — | 1.2 | 0.5 | — |
| VHTIM-3 | R | — | — | — | — | 1.6 | — | — | — | 27.5 | 4.7 | — | 0.1 | — | 1.2 | 1 | — |
| VHTIM-4 | R | — | — | — | — | 1 | — | — | — | 27.5 | 4.7 | — | 0.1 | — | 1 | 0.5 | — |
| VHTIM-5 | R | — | — | — | — | 0.5 | — | — | — | 27.5 | 4.7 | — | 0.1 | — | 0.5 | 0.5 | — |
| VHTIM-6 | R | — | — | — | — | 0.2 | — | — | — | 27.5 | 4.7 | — | 0.1 | — | 0.2 | 0.5 | 1 |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A high-temperature material based on alloyed intermetallic NiAl having the following chemical composition (values in % by weight):

26-30 Al,
1-6 Ta,
0.1-3 Fe,
0.1-1.5 Hf,
0.01-0.2 B,
0-1 Ti,
0.1-5 Pd,
with the remainder Ni and production-related impurities.

2. A high-temperature material according to claim 1, wherein the Al content is 27-28% by weight.

3. A high-temperature material according to claim 1, wherein the Al content is 27.5% by weight.

4. A high-temperature material according to claim 1, wherein the Ta content is 2-5% by weight.

5. A high-temperature material according to claim 1, wherein the Ta content is 4.7% by weight.

6. A high-temperature material according to claim 1, wherein the Fe content is 0.2-2% by weight.

7. A high-temperature material according to claim 1, wherein the Fe content is 1.6% by weight.

8. A high-temperature material according to claim 1, wherein the Hf content is 0.2-1.2% by weight.

9. A high-temperature material according to claim 1, wherein the Hf content is 1.2% by weight.

10. A high-temperature material according to claim 1, wherein the B content is 0.01-0.1% by weight.

11. A high-temperature material according to claim 1, wherein the B content is 0.1% by weight.

12. A high-temperature material according to claim 1, wherein the Pd content is 1-3% by weight.

13. A high-temperature material according to claim 1, wherein the Pd content is 0.5% by weight.

14. A high-temperature material according to claim 1, wherein the Ti content is 1% by weight.

* * * * *